US010907817B2

(12) United States Patent
Qin

(10) Patent No.: US 10,907,817 B2
(45) Date of Patent: Feb. 2, 2021

(54) SCREW TYPE LIGHT-EMITTING DEVICE AND BALLOON LIGHT WITH THE LIGHT-EMITTING DEVICE

(71) Applicant: ACE LIGHT & ELECTRONIC TECH (NINGBO) CO., LTD., Ningbo (CN)

(72) Inventor: Yanbei Qin, Ningbo (CN)

(73) Assignee: ACE LIGHT & ELECTRONIC TECH (NINGBO) CO., LTD., Ningbo (CN)

( * ) Notice: Subject to any disclaimer, the term of this patent is extended or adjusted under 35 U.S.C. 154(b) by 0 days.

(21) Appl. No.: 16/349,882

(22) PCT Filed: Jun. 12, 2018

(86) PCT No.: PCT/CN2018/090843
§ 371 (c)(1),
(2) Date: May 14, 2019

(87) PCT Pub. No.: WO2019/223034
PCT Pub. Date: Nov. 28, 2019

(65) Prior Publication Data

US 2020/0263864 A1 Aug. 20, 2020

(30) Foreign Application Priority Data

May 23, 2018 (CN) ..... 2018 1 0498363

(51) Int. Cl.
*F21V 23/06* (2006.01)
*A63H 27/10* (2006.01)
(Continued)

(52) U.S. Cl.
CPC ..... *F21V 23/06* (2013.01); *A63H 27/10* (2013.01); *F21L 4/00* (2013.01); *F21V 3/026* (2013.01);
(Continued)

(58) Field of Classification Search
CPC ..... F21V 23/06; F21V 3/026; A63H 27/10; F21L 4/00
See application file for complete search history.

(56) References Cited

U.S. PATENT DOCUMENTS 7,147,536 B1 12/2006 Hartelius
7,318,765 B1 * 1/2008 Hartelius ..... A63H 27/10 446/220
(Continued)

FOREIGN PATENT DOCUMENTS

CN 201599718 U 10/2010
CN 201684419 U 12/2010
(Continued)

OTHER PUBLICATIONS

International Search Report dated Dec. 12, 2018 from corresponding PCT Application No. PCT/CN2018/090843.
(Continued)

*Primary Examiner* — Thomas M Sember
(74) *Attorney, Agent, or Firm* — Innovation Capital Law Group, LLP; Vic Lin

(57) ABSTRACT

A screw type light-emitting device comprises a hollow mounting holder; a screw holder disposed over the mounting holder and threadedly connected with the same; a battery case disposed in the mounting holder and relatively fixed with the same; a battery pack removably disposed in the battery case 30; an LED light disposed at one end of the battery case and extending out of the mounting holder, wherein one of the electrodes of the LED light is electrically connected to the battery pack, and the other electrode extends to between the battery pack and the screw holder; both the LED light and the battery pack are mounted in the battery case, the battery case is mounted in the mounting holder, and the mounting holder is threadedly connected
(Continued)

with the screw holder, and the LED light will emit light when the screw holder is rotated into a proper position.

11 Claims, 8 Drawing Sheets

(51) Int. Cl.
*F21L 4/00* (2006.01)
*F21V 3/02* (2006.01)
*F21Y 115/10* (2016.01)

(52) U.S. Cl.
CPC ... *A63H 2027/1058* (2013.01); *F21Y 2115/10* (2016.08)

(56) References Cited

U.S. PATENT DOCUMENTS

| | | | |
|---|---|---|---|
| 2005/0269442 | A1 | 12/2005 | Nguyen et al. |
| 2009/0067154 | A1 | 3/2009 | Carito |

FOREIGN PATENT DOCUMENTS

| | | | |
|---|---|---|---|
| CN | 102500114 | A | 6/2012 |
| CN | 202501358 | U | 10/2012 |
| CN | 202607607 | U | 12/2012 |
| CN | 205690153 | U | 11/2016 |

OTHER PUBLICATIONS

International Search Report dated Dec. 12, 2018 from related PCT Application No. PCT/CN2018/090844.

* cited by examiner

SCREW TYPE LIGHT-EMITTING DEVICE AND BALLOON LIGHT WITH THE LIGHT-EMITTING DEVICE

BACKGROUND OF THE INVENTION

1. Technical Field

The present invention belongs to the field of photoelectric technology, and relates to a light-emitting device and a balloon light, and more especially, to a screw type light-emitting device and a balloon light with the light-emitting device.

2. Description of Related Art

As an innovative material used in activity arrangement, the LED balloon light provides a new creative idea for arranging various Avenue of Stars, outdoor lawns, open squares, and emptying stages in activities. It combines activity lighting, activity slogans, activity spaces, and activity decoration, adding a lot of highlights to the activities and showing the activity's taste. The light is especially suitable for creating a site atmosphere for high-end activities, and has a wide range of applications.

For example, the invention patent with the Authorized Publication No. of 201684419U discloses a colorful balloon with LED lights which comprises a balloon body, wherein the balloon body has an air inlet in the middle of its bottom, the upper end of the air inlet is fixed with an LED light power supply and circuit case with a battery, an LED light fixing plate is provided on the upper end of the case, an LED light group is fixed on the fixing plate and a plug is inserted in the end opening of the air inlet. This balloon can emit light, but it has the following technical problems: 1. The LED light power supply and circuit box and the plug are separate, so the whole light is relatively disperse in the structure, poor in stability, and troublesome to disassemble, and the normal operation of the LED light is easily affected during assembly and disassembly; 2. the light-emitting device comprising the LED light group and the circuit case is fixedly connected with the plug, and the plug is inserted in the air inlet of the balloon body, so the LED light group has to be removed together with the plug to let the air in or out of the balloon body, which is quite inconvenient for use.

To sum up, in order to solve the technical problems of the above-mentioned balloon with lights, there is a need to design a light-emitting device with good light-emitting stability and a balloon light with the light-emitting device which is convenient to use.

BRIEF SUMMARY OF THE INVENTION

The present invention aims to provide a well-integrated, compact and stable screw-type light-emitting device to solve the foregoing problems in the prior art.

The objective of the present invention can be achieved by the following technical solution: a screw-type light-emitting device, comprising a hollow mounting holder;

a screw holder located over the mounting holder and threadedly connected with the same;

a battery case disposed in the mounting holder and relatively fixed with the same;

a battery pack removably mounted in the battery case;

an LED light disposed at one end of the battery case and extending out of the mounting holder, wherein one of the electrodes of the LED light is electrically connected to the battery pack, and the other electrode extends to between the battery pack and the screw holder; and as the screw holder rotates, it moves axially relative to the mounting holder and presses the other electrode of the LED light against the batteries to enable the LED light to emit light.

In the screw-type light-emitting device, the inner surface of the screw holder is convexly provided with a press-against seat, wherein the press-against seat is made with a breather hole communicating with the inside and outside of the screw holder, and it can move with the screw holder synchronously and press the LED light electrode against the battery pack.

In the screw-type light-emitting device, the press-against seat is formed by recessing the end face of the screw holder towards the inside of the screw holder, outside of the press-against seat is a breather recess formed by the recessing, and the breather hole is made through a sidewall of the press-against seat and communicates with the breather recess.

In the screw-type light-emitting device, the outer surface of the mounting holder is convexly provided with a first retaining ring, the inner surface of one end of the screw holder is provided with a second retaining ring, and corresponding slopes are made on the first retaining ring and the second retaining ring, such that the slopes enable the first retaining ring to enter the screw holder, and when the screw holder and the mounting holder move away from each other, the second retaining ring rests against the first retaining ring.

In the screw-type light-emitting device, the outer surface of the end of the battery case opposite to the screw holder is laterally provided with a slot which is separated from the battery pack, a conductive base is inserted in the slot and connected with one electrode of the LED light, and the conductive base is provided with a conductive piece which can move relative to the conductive base, such that as the screw holder rotates, it can press the conductive piece against the battery pack.

In the screw-type light-emitting device, a retaining hole is made through the battery case, a retaining block is convexly provided on the conductive base, and the retaining block extends into the retaining hole.

In the screw-type light-emitting device, the outer surface of the battery case is provided with a mounting opening through which the battery pack is laterally placed into the battery case.

In the screw-type light-emitting device, a mounting shield with one open side is provided at one end of the battery case, a mounting groove is made in the inner surface of the mounting shield, and the LED light is embedded in the mounting groove and extends out of the mounting shield.

In the screw-type light-emitting device, the LED light has two conductive electrode pins, one of which extends out of the mounting shield to contact the battery pack in the battery case, and the other one extends out of the mounting shield and extends along the outside of the battery case to connect with the conductive base.

In the screw-type light-emitting device, the outer surface of one end of the battery case is provided with a retaining slot which extends through the battery case and is adjacent to the mounting shield, and the said one conductive electrode pin is placed in the retaining slot; and the outer surface of the battery case is axially provided with a receiving groove in which the said other conductive electrode pin is placed.

The present invention also aims to provide a balloon light with the above-described light-emitting device which is convenient to use, to solve the problems in the prior art.

The objective of the present invention can be achieved by the following technical solution: a balloon light with the above-described light-emitting device, comprising a balloon body with an air guide portion, wherein the screw holder, the mounting holder, and the battery case are disposed in the air guide portion, a locking block is provided in the outer surface of the screw holder, a mounting sleeve is provided over the balloon body, a locking groove is made in the inner surface of the mounting sleeve, and the locking block is stuck in the locking groove such that the balloon body, the screw holder, and the mounting sleeve are fixedly connected.

Compared with the prior art, the present invention has the following beneficial effects:

1. In the present invention, both the LED light and the battery pack are mounted in the battery case, the battery case is mounted in the mounting holder, and the mounting holder is threadedly connected with the screw holder such that these parts form a compact whole body which eliminates the trouble of disassembling, and the LED light will emit light when the screw holder is rotated into a proper position, so the device is stable and convenient to control.

2. According to the present invention, the fixed connection between the screw holder and the balloon body is achieved by means of the mounting sleeve, and the battery case, the mounting holder and the screw holder communicate with one another such that there is no need to disassemble the whole light-emitting device to inflate and deflate the balloon body, and the LED light emits light in both the inflated and deflated states, so it is convenient and flexible to use and has a long service life.

Figure 1:
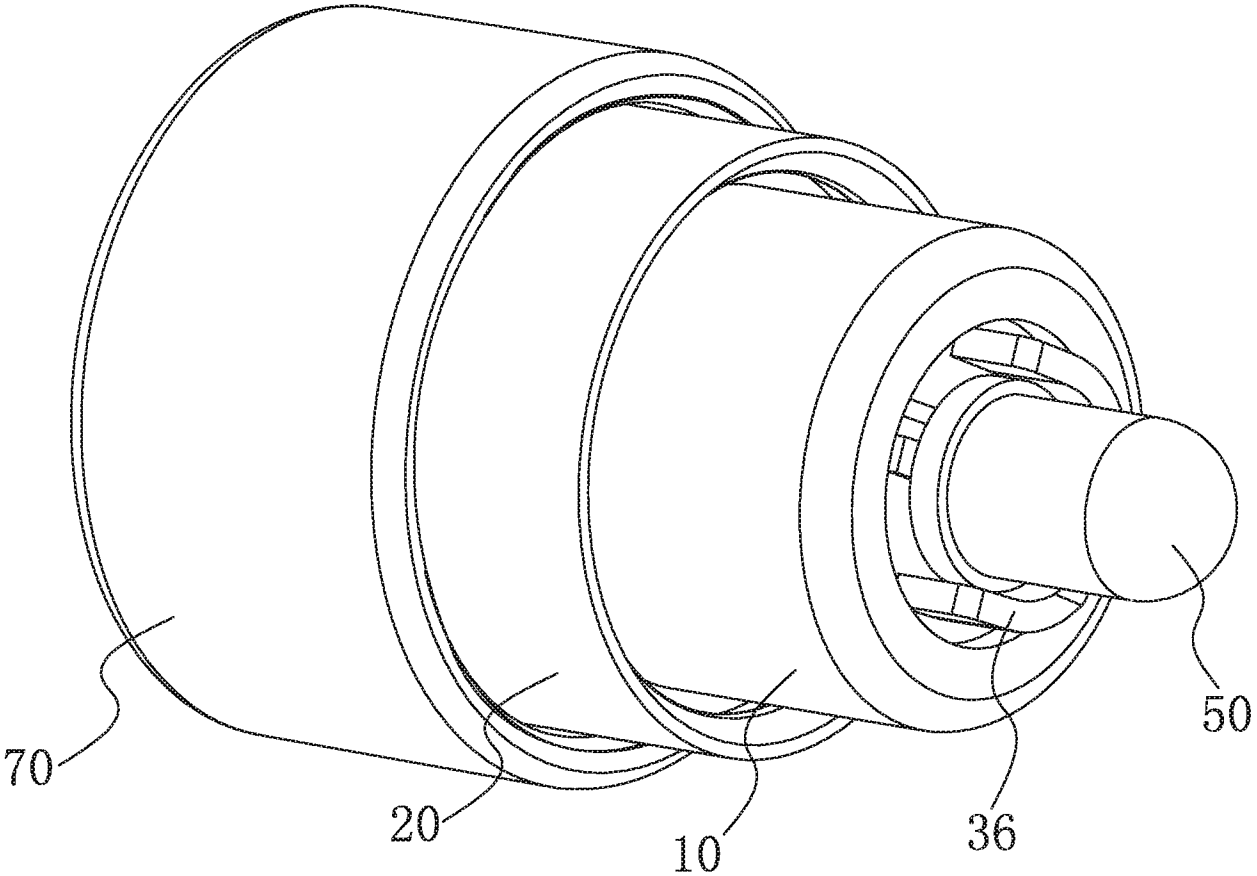
FIG. 1 is a perspective structural diagram of the light-emitting device of the present invention.

In the drawings, 10. mounting holder; 11. thru hole; 12. first retaining ring; 13. first slope; 20. screw holder; 21. press-against seat; 21*a*. breather recess; 21*b*. breather hole; 22. second retaining ring; 23. second slope; 24. locking block; 30. battery case; 31. slot; 32. separation plate; 32*a*. contact hole; 33. conductive base; 33*a*. conductive piece; 33*b*. retaining block; 34. retaining hole; 35. mounting opening; 36. mounting shield; 37. retaining slot; 38. receiving groove; 40. battery pack; 50. LED light; 51. anode conductive pin; 52. cathode conductive pin; 60. balloon body; 61. air guide portion; 62. air inlet; 70. mounting sleeve; 71. locking groove.

DETAILED DESCRIPTION OF THE INVENTION

The detailed implementation of the present invention will be given below, and the technical solution of the present invention will be further described in combination with the drawings, but the present invention is not limited to these embodiments.

The objective of the present invention is to improve the light-emitting device of the existing balloon light and the structure of the whole balloon light so as to improve the stability of the light-emitting device and the ease of use of the balloon light.

As shown in FIG. 1, FIG. 2, FIG. 6, FIG. 7 and FIG. 8, a screw type light emitting device of the present invention comprises a mounting holder 10, a screw holder 20, a battery case 30, a battery pack 40, and an LED light 50.

The mounting holder 10 is a hollow barrel-shaped structure, one end of which is open and the other end has a thru hole 11 with a diameter less than that of the cylinder. The screw holder 20 is also a barrel-shaped structure with a diameter slightly greater than that of the mounting holder 10, the end of the screw holder 20 adjacent to the mounting holder 10 is open, and the screw holder 20 is disposed over the mounting holder 10 and threadedly connected with the same. The battery case 30 is a cylinder disposed in the mounting holder 10 and pressed against the inner surface of the end with the thru hole 11, and it is relatively fixed with the mounting holder 10. The battery pack 40 comprises three stacked block-shaped batteries, and it is removably disposed in the battery case 30. The LED light 50 is disposed at one end of the battery case 30 and extends out of the thru hole 11. One electrode of the LED light 50 is electrically connected with the battery pack 40, and the other electrode extends to between the battery pack 40 and the screw holder 20.

In operation, the screw holder 20 is rotated under the action of an applied force. As the screw holder 20 rotates, it moves relative to the mounting holder 10 in the axial direction. The screw holder 20 and the mounting holder 10 come closer to each other in the relative movement, so that the screw holder 20 comes into contact with the other electrode of the LED light 50 and presses it against the batteries. At this point, the electrodes of the LED light 50 contact the two electrodes of the battery pack 40 respectively, thereby enabling the LED light to emit light.

In this structure, the axial rotation of the screw holder 20 is converted into a linear motion, enabling the screw holder 20 to move relative to the mounting holder 10 while rotating, so that the screw holder 20 comes into contact with the other electrode of the LED light 50 and presses it against the battery pack 40. The battery pack 40 is electrically connected with the LED light 50, thereby enabling the LED light 50 to emit light. This structure is well-integrated, simple, compact and easy to assemble and disassemble.

According to the present invention, the foregoing structure is further refined and improved.

Figure 2:
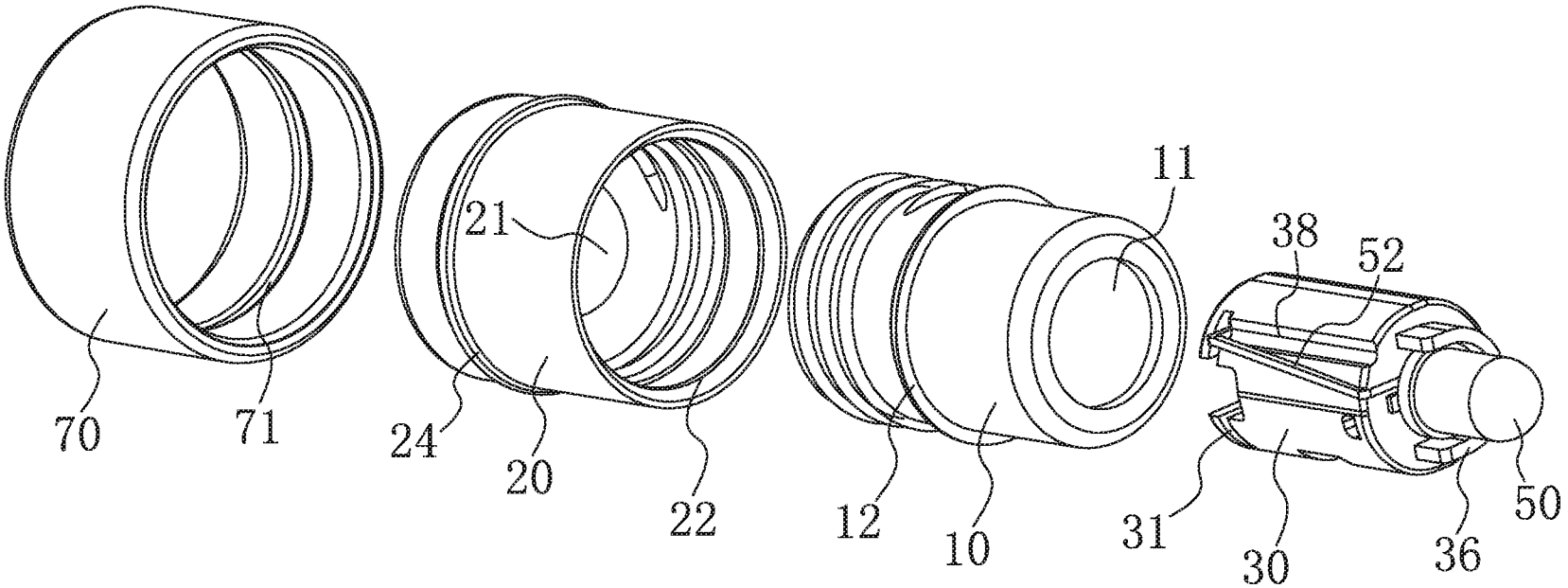
FIG. 2 is a schematic exploded view of the light-emitting device of the present invention.
Figure 6:
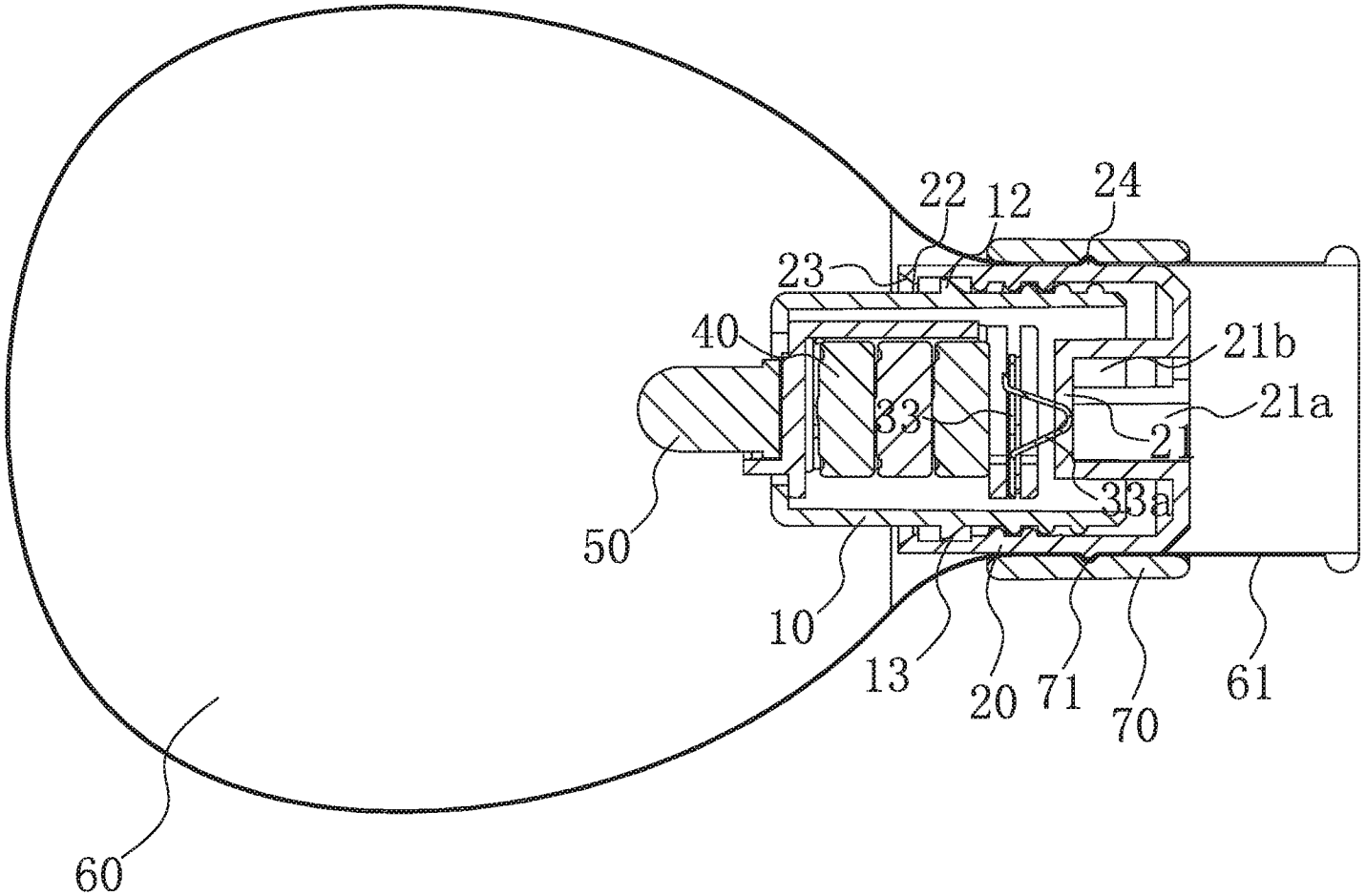
FIG. 6 is a sectional view of the balloon light of the present invention.
Figure 7:
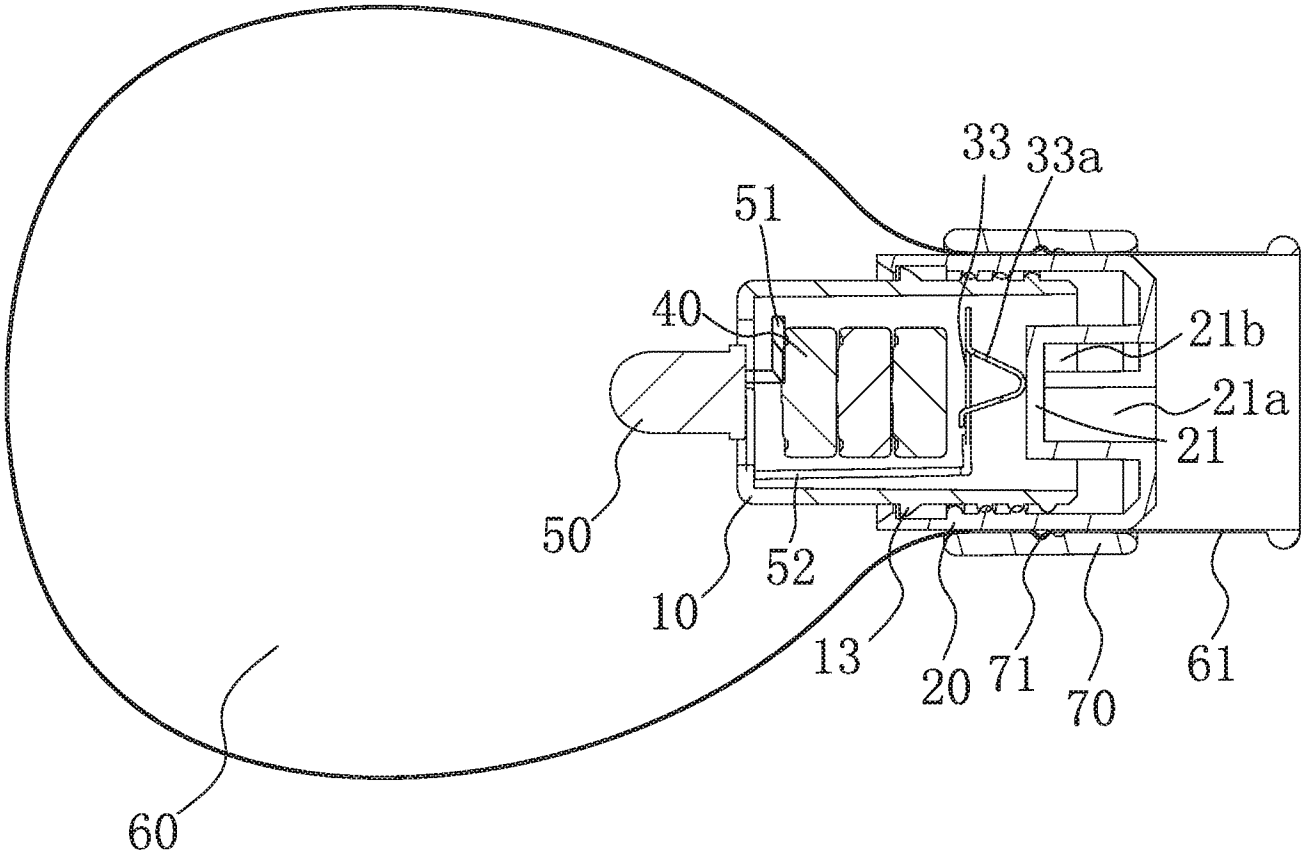
FIG. 7 is a sectional view of the balloon light which hides mounting shield of the present invention when the LED light does not emit light.
Figure 8:
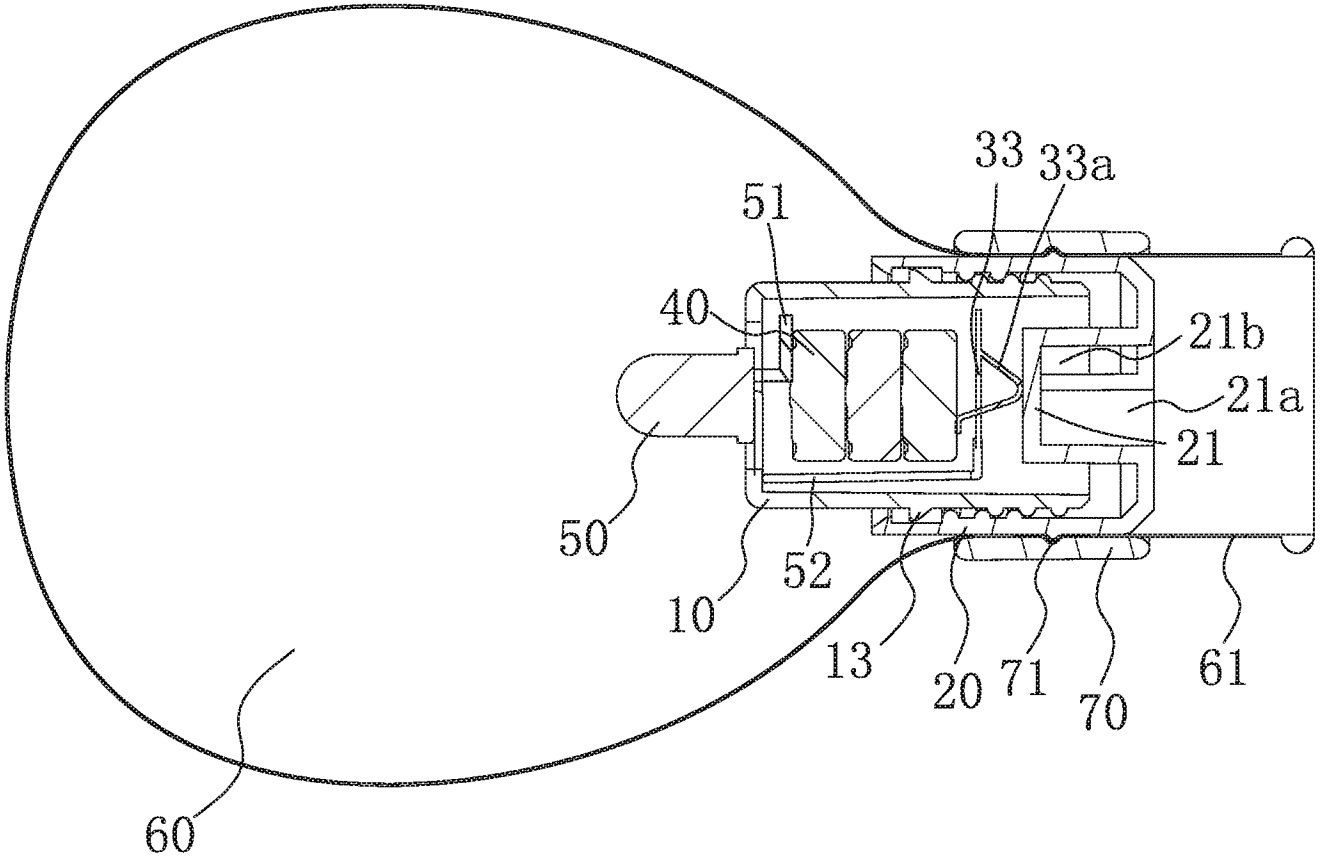
FIG. 8 is a sectional view of the balloon light which hides mounting shield of the present invention when the screw holder rotates and the LED light emit light.

As shown in FIG. 2 and FIG. 6, the inner surface of the screw holder 20 is convexly provided with a press-against seat 21, the press-against seat 21 is formed by recessing the end face of the screw holder 20 towards the inside of the screw holder 20, and the outside of the press-against seat 21 is a breather recess 21*a* formed by the recessing, and a sidewall of the press-against seat 21 is made with a breather hole 21*b* which extends through the press-against seat 21 and communicates with the breather recess 21*a*.

The press-against seat 21 extends axially, and it can move synchronously with the screw holder 20 and press the electrode of the LED light 50 against the battery pack 40.

By providing the press-against seat 21, the screw holder 20 contacts the electrode of the LED light 50 physically. As the screw holder 20 rotates, the press-against seat 21 moves to contact the electrode of the LED light 50 more accurately. The contact is more convenient, and at the same time, the control accuracy of the screw holder 20 is improved.

As shown in FIG. 6, the outer surface of the mounting holder 10 is convexly provided with a first retaining ring 12, a first slope 13 is made on the first retaining ring 12, the inner surface of one end of the screw holder 20 is provided with a second retaining ring 22, and a second slope 23 is made on the second retaining ring 22, such that the first slope 13 and the second slope 23 enable the first retaining ring 12 to enter the screw holder, and when the screw holder 20 and the mounting holder 10 move away from each other, the second retaining ring 22 rests against the first retaining ring 12. Besides, the angle at which the screw holder 20 can rotate relative to the mounting holder 10 is set to be 30°. The screw holder 20 can control the LED light 50 and it will not separate from the mounting holder 10 within 30°, but the angle may be selected according to actual conditions.

In assembly, the screw holder 20 may be threadedly mounted on the mounting holder 10. Since the first slope 13 and the second slope 23 fit as the screw holder 20 and the mounting holder 10 move closer to each other. When the screw holder 20 moves to the point where the first slope 13 contact the second slope 23, the second retaining ring 22 slightly expands to allow the first retaining ring 12 to enter the screw holder, thereby completing the assembly of the screw holder 20 and the mounting holder 10. When the screw holder 20 and the mounting holder 10 move away from each other, the second retaining ring 22 rests against the first retaining ring 12, so that the screw holder 20 is not easily separated from the mounting holder 10.

In this structure, once assembled, the screw holder 20 and the mounting holder 10 always function as one whole body, which provides good stability and integrity and avoids repeated separation and reassembly of the screw holder 20 and the mounting holder 10. So the light is convenient to use and efficiently controlled.

Figure 3:
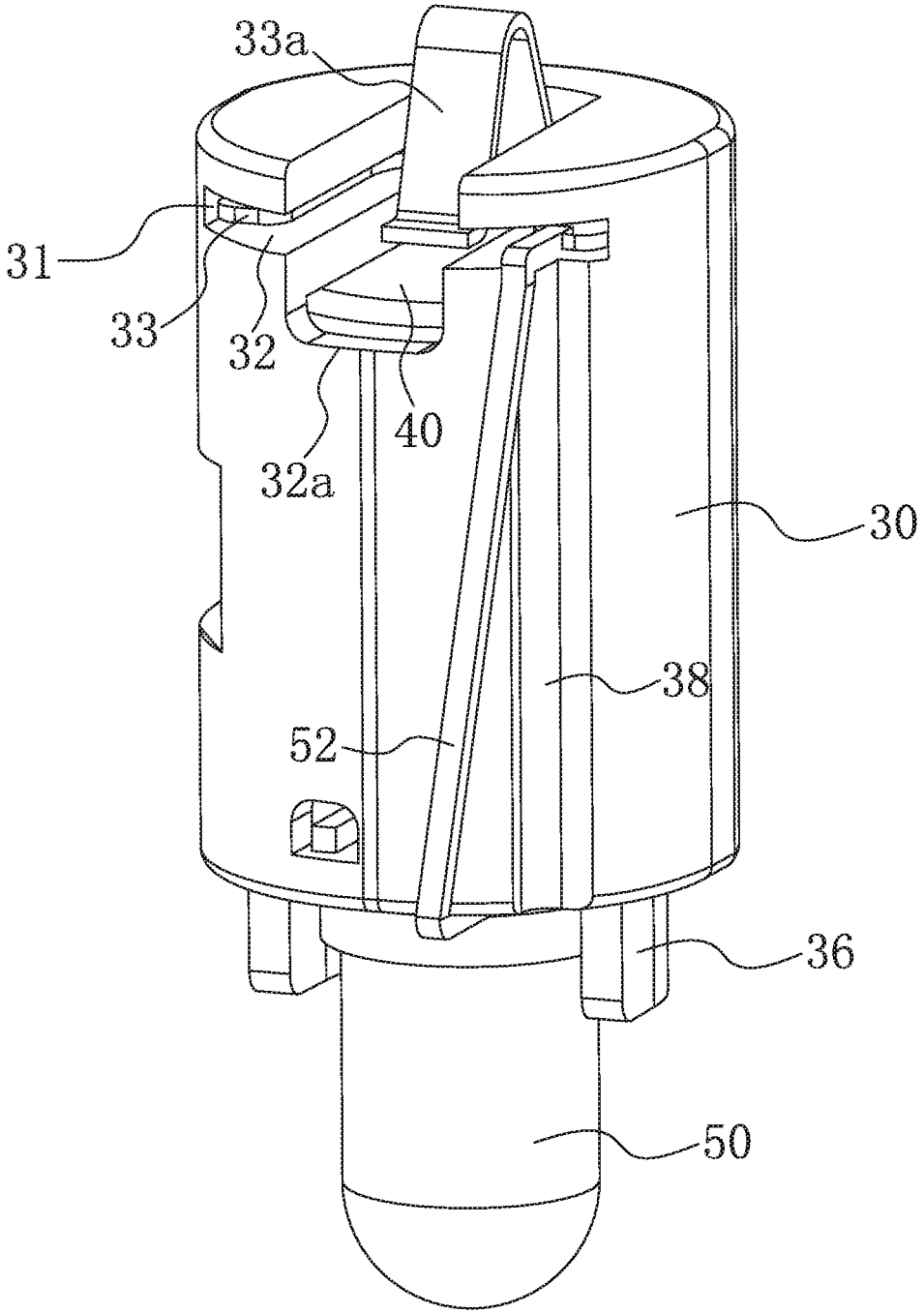
FIG. 3 is a perspective view of the front of the battery case in the present invention.

As shown in FIG. 3, the outer surface of the end of the battery case 30 opposite to the screw holder 20 is laterally made with a slot 31 which is separated from the battery pack 40 by a separation plate 32. A metal conductive base 33 is inserted in the slot 31 and connected with one electrode of the LED light 50, and the conductive base 33 is provided with a conductive piece 33*a*. The conductive piece 33*a* has a bent shape, the bent portion protrudes out of the battery case 30, and the conductive piece 33*a* is flexible and can move relative to the conductive base 33. The separation plate 32 is made with a contact hole 32*a* where the conductive piece 32*a* moves. As the screw holder 20 rotates, the press-against seat 21 contacts the conductive piece 33*a*, and presses the same against the battery pack 40 through the contact hole 32*a*.

By providing the conductive base 33, the press-against seat 21 does not contact the electrode of the LED light 50 directly, which protects the LED light 50. The flexible conductive piece 33*a* is driven by the press-against seat 21 to efficiently contact the battery pack 40 which improves the control sensitivity. And, the whole conductive base 33 is stably inserted in the slot 31, which facilitates the disassembly and assembly of the conductive base 33.

Figure 4:
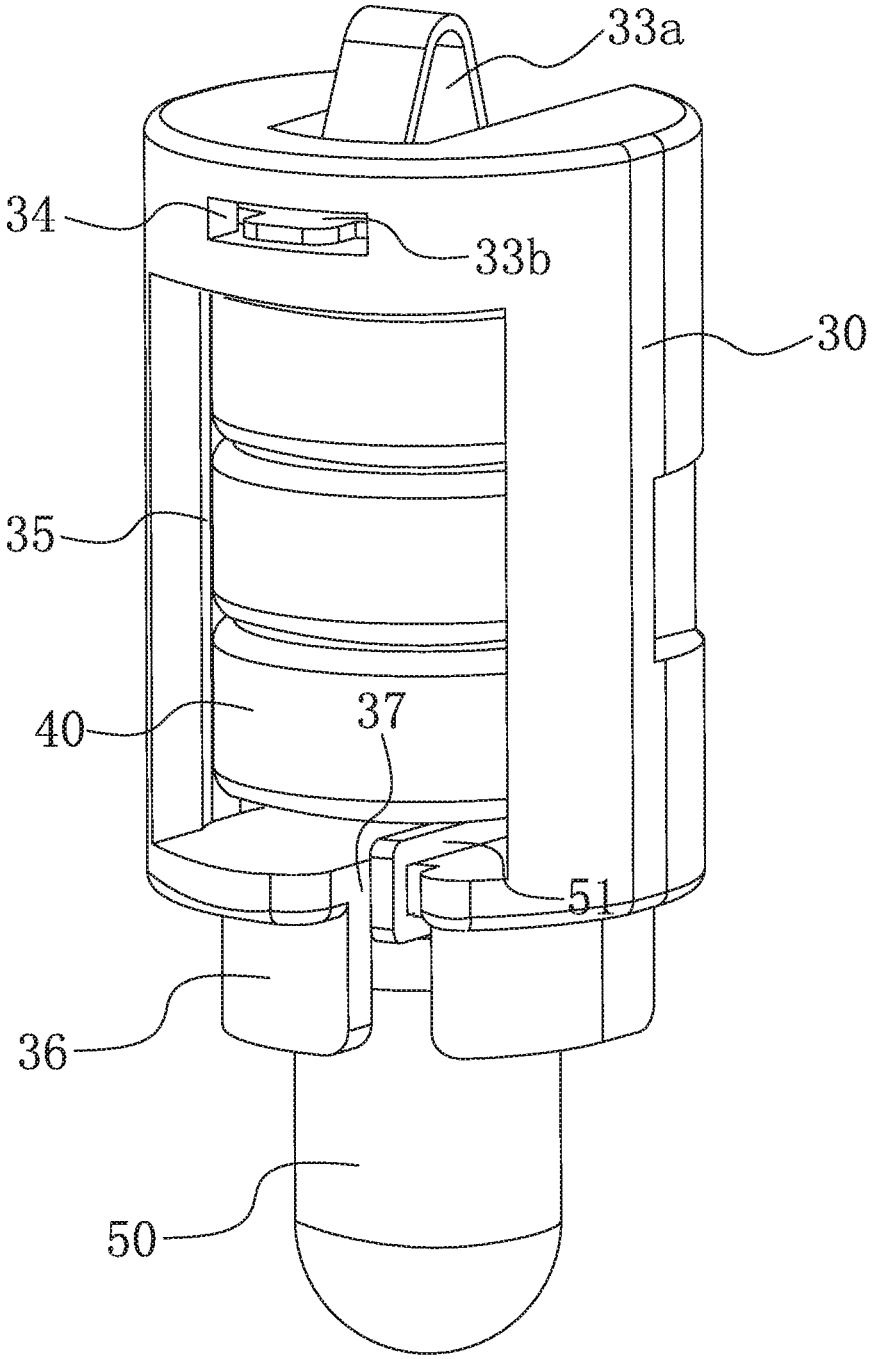
FIG. 4 is a perspective view of the back of the battery case in the present invention.

As shown in FIG. 4, a retaining hole 34 is made through the battery case 30, a retaining block 33*b* is provided on the conductive base 33, and the retaining block 33*b* extends into the retaining hole 34.

The fit of the retaining block 33*b* with the retaining hole 34 can prevent the conductive piece from moving around in the battery case 30, further improving the stability of the conductive base 33 in the battery case 30, and ensuring the control sensitivity of the whole structure.

As shown in FIG. 4, the outer surface of the battery case 30 is made with a mounting opening 35 through which the battery pack 40 is placed into the battery case 30.

The battery pack 40 is laterally put into the battery case 30 through the mounting opening 35, which makes assembly and disassembly of the battery pack convenient and quick. The battery base 30 is not designed as the combination of an upper case body and a lower case body, so the battery case 30 has a simple one-piece body which can fix the battery pack 40 reliably.

As shown in FIGS. 2-4 a mounting shield 36 with one open side is provided at one end of the battery case 30, a mounting groove (not shown) is made in the inner surface of the mounting shield 36, and the LED light 50 is embedded in the mounting groove and extends out of the mounting shield 36.

The mounting shield 36 is located outside of the battery case 30 so that the LED light 50 is separated from the battery pack 40. The LED light 50 and the battery pack 40 are assembled in a flexible manner and do not have to be assembled in order. The LED light 50 is embedded in the mounting groove, which facilitates the assembly and disassembly of the LED light 50. And, the LED light 50 is fixed in the axial direction, which provides a better fixation effect.

As shown in FIG. 3 and FIG. 4, the LED light 50 has two conductive electrode pins, one of which extends out of the mounting shield 36 and goes into the battery case 30 through the mounting opening 35 to contact the battery pack 40, and the other one extends out of the mounting shield 36 through the opening of the mounting shield 36 and runs along the outside of the battery case 30 to connect with the conductive base 33. The two conductive electrode pins extend out in opposite directions. The short conductive electrode pin is regarded as the positive conductive pin 51, and the long conductive electrode pin which extends out of the mounting shield 36 and runs along the outside of the battery case 30 is regarded as the negative conductive pin 52. The positive conductive pin 51 and the negative conductive pin 52 may be correspondingly reversed.

Two conductive electrode pins of different lengths are provided for the LED light 50, which achieves the two conductive electrode pins contacting the two electrodes of the battery pack 40 respectively. The two conductive electrode pins extend in opposite directions, which avoids short-circuits due to contact of the two conductive electrode pins. The positive conductive pin 51 is disposed in the retaining slot 37, improving the stability of the positive conductive pin 51, while the negative conductive pin 52 extends out of the battery case 30 to bypass the battery pack 40, which avoids short circuits due to its contact with the battery pack 40.

As shown in FIG. 4, the outer surface of one end of the battery case 30 is made with a retaining slot 37 which extends through the battery case 30 and is adjacent to the mounting shield 36, the retaining slot 37 is located between the mounting shield 36 and the mounting opening 35, the positive conductive pin 51 is placed in the retaining slot 37, and the outer surface of the battery case 30 is axially made with a receiving groove 38 in which the negative conductive pin 52 is placed.

The positive conductive pin 51 and the negative conductive pin 52 are restricted to the retaining slot 37 and the receiving groove 38 respectively to prevent the positive conductive pin 51 and the negative conductive pin 52 from shaking relative to the battery case 30, thereby improving the stability of the positive conductive pin 51 and the negative conductive pin 52 and ensuring that the LED light 50 emits light normally.

Figure 5:
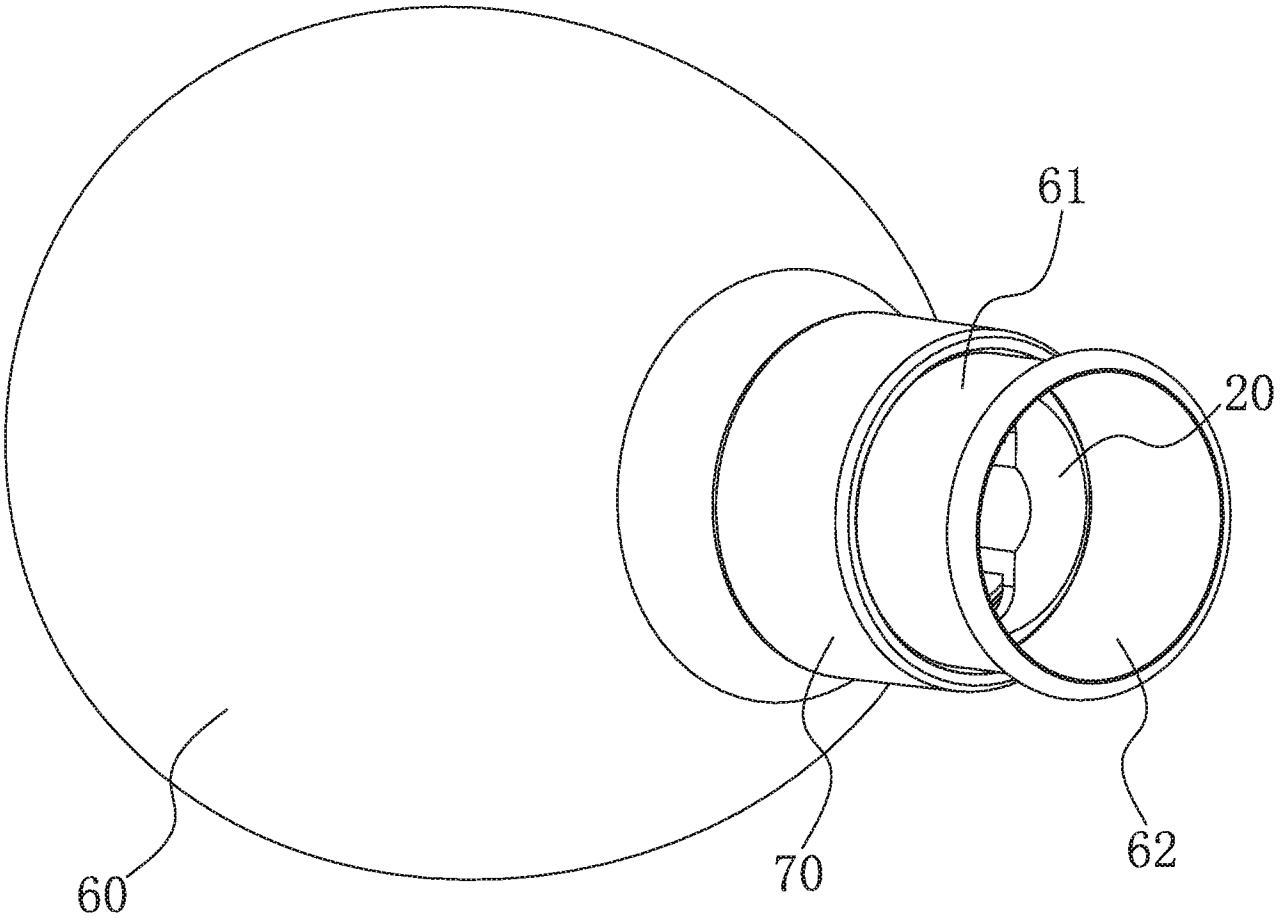
FIG. 5 is a perspective structural diagram of the balloon light of the present invention.

As shown in FIG. 5 and FIG. 6, a balloon light with the light-emitting device of the present invention comprises a balloon body 60 with an air guide portion 61, wherein the air inlet portion 61 has an air inlet 62, the screw holder 20, the mounting holder 10 and the battery case 30 are disposed in the air guide portion 61, a locking block 24 is provided in the outer surface of the screw holder 20, a mounting sleeve 70 is provided over the balloon body 60, a locking groove 71 is made in the inner surface of the mounting sleeve 70, and the locking block 24 is stuck in the locking groove 71 such that the balloon body 60, the screw holder 20, and the mounting sleeve 70 are fixedly connected.

The balloon body 60 is located between the mounting sleeve 70 and the screw holder 20 and clamped by the two to fix the whole light-emitting device and the balloon body 60 together securely, so that the light-emitting device will not move in the balloon body 60. The mounting sleeve 70 and the screw holder 20 are engaged with each other by means of the locking block 24 and the locking groove 71, so that the mounting sleeve 70 is easily disassembled from the balloon body 60 and the screw holder 20.

By placing the light-emitting device in the balloon body 60, the LED light 50 emits light to illuminate the balloon body 60, thereby bringing a different lighting effect to the balloon body 60, and adding a different site atmosphere.

When the balloon light is inflated, the air enters the screw holder through the breather recess 21*a* and the breather hole 21*b* of the press-against seat 21, flows through the mounting holder 10 into the battery case 30, and then finally flows through the retaining slot 37 of the battery case 30 into the balloon body 60. The air is also discharged through the path. With this air guide structure, the light-emitting device does not have to be disassembled from the balloon body 60 in inflation and deflation.

Since the light-emitting device is placed inside the balloon body 60 and the air inlet 62 of the balloon body 60 does not have any means for sealing, a knot must be made at the air guide portion 61 to block up the air inlet 62 and keep the air in the balloon body 60 after the balloon body 60 is inflated. To deflate the balloon light, undo the knot.

The operating principle of the present invention is as follows:

The balloon light is assembled as described below: the battery case 30 is placed in the mounting holder 10, the battery case 30 is restricted to the mounting holder 10 by threadedly connecting the screw holder 20 with the mounting holder 10, the light-emitting device comprising the battery case 30, the mounting holder 10 and the screw holder 20 is placed into the balloon body 60 through the air inlet 62, and the mounting sleeve 70 is put over the balloon body 60 and fixed with the screw holder 20, thereby fixing the mounting sleeve 70, the balloon body 60 and light-emitting device together.

In the initial state, the press-against seat 21 is separate from the conductive piece 33*a*. The screw holder 20 is rotated to move relative to the mounting holder 10. When the press-against seat 21 contacts the conductive piece 33*a* and presses the conductive piece 33*a* against the battery pack 40, the battery pack 40 is electrically connected with the LED light 50, so that the LED light 50 emits light.

To turn off the LED light 50, the screw holder 20 is rotated in the reverse direction. When the press-against seat 21 is separate from the conductive piece 33*a*, the LED light 50 is off.

The balloon body 60 is inflated and deflated through the air inlet 62 of the air guide portion 61.

The specific embodiments described herein are merely illustrative of the spirit of the present invention. Those skilled in the technical field of the present invention can make various modifications or additions to the specific embodiments described or adopt similar alternates, without departing from the spirit of the present invention or going beyond the scope as defined by the attached claims.

What is claimed is:

1. A screw type light emitting device, comprising:

a hollow mounting holder;

a screw holder located over the mounting holder and threadedly connected with the mounting holder;

a battery case disposed in the mounting holder and relatively fixed with the mounting holder;

a battery pack removably mounted in the battery case;

an LED light disposed at one end of the battery case and extending out of the mounting holder, wherein one electrode of the LED light is electrically connected to the battery pack, and an other electrode extends between the battery pack and the screw holder; and as the screw holder rotates, it moves axially relative to the mounting holder and presses the other electrode of the LED light against batteries to enable the LED light to emit light.

2. The screw-type light-emitting device as claimed in claim 1, characterized in that an inner surface of the screw holder is convexly provided with a press-against seat, wherein the press-against seat is provided with a breather hole communicating with an inside and an outside of the screw holder, and it can move with the screw holder synchronously and press the other electrode of the LED light which extends between the battery pack and the screw holder against the battery pack.

3. The screw-type light-emitting device as claimed in claim 2, characterized in that the press-against seat is formed by recessing an end face of the screw holder towards the inside of the screw holder, outside of the press-against seat is a breather recess formed by the recessing, and the breather hole is formed through a sidewall of the press-against seat and communicates with the breather recess.

4. The screw-type light-emitting device as claimed in claim 1, characterized in that an outer surface of the mounting holder is convexly provided with a first retaining ring, an inner surface of one end of the screw holder is provided with a second retaining ring, and corresponding slopes are made on the first retaining ring and the second retaining ring, such that the slopes enable the first retaining ring to enter the screw holder, and when the screw holder and the mounting holder move away from each other, the second retaining ring rests against the first retaining ring.

5. The screw-type light-emitting device as claimed in claim 1, characterized in that an outer surface of the end of the battery case opposite to the screw holder is laterally provided with a slot which is separated from the battery pack, a conductive base is inserted in the slot and connected with the electrode of the LED light electrically connected to the battery pack, and the conductive base is provided with a conductive piece which can move relative to the conductive base, such that as the screw holder rotates, it can press the conductive piece against the battery pack.

6. The screw-type light-emitting device as claimed in claim 5, characterized in that a retaining hole is made through the battery case, a retaining block is convexly provided on the conductive base, and the retaining block extends into the retaining hole.

7. The screw-type light-emitting device as claimed in claim 1, characterized in that an outer surface of the battery case is provided with a mounting opening through which the battery pack is laterally placed into the battery case.

8. The screw-type light-emitting device as claimed in claim 1, characterized in that a mounting shield with one open side is provided at one end of the battery case, a mounting groove is made in an inner surface of the mounting shield, and the LED light is embedded in the mounting groove and extends out of the mounting shield.

9. The screw-type light-emitting device as claimed in claim 1, characterized in that the LED light has two conductive electrode pins, one of which extends out of the mounting shield to contact the battery pack in the battery case, and the other one extends out of the mounting shield and extends along an outside of the battery case to connect with the conductive base.

10. The screw-type light-emitting device as claimed in claim 9, characterized in that an outer surface of one end of the battery case is provided with a retaining slot which extends through the battery case and is adjacent to the mounting shield, and the said one conductive electrode pin is placed in the retaining slot; and the outer surface of the battery case is axially provided with a receiving groove in which the said other conductive electrode pin is placed.

11. A balloon light with the light-emitting device as claimed in claim 1, characterized in that it comprises a balloon body with an air guide portion, wherein the screw holder, the mounting holder, and the battery case are disposed in the air guide portion, a locking block is provided in an outer surface of the screw holder, a mounting sleeve is provided over the balloon body, a locking groove is made in an inner surface of the mounting sleeve, and the locking block is stuck in the locking groove such that the balloon body, the screw holder, and the mounting sleeve are fixedly connected.

* * * * *